United States Patent [19]

Chibana et al.

[11] 4,114,498

[45] Sep. 19, 1978

[54] ELECTRONIC MUSICAL INSTRUMENT HAVING AN ELECTRONIC FILTER WITH TIME VARIANT SLOPE

[75] Inventors: Masanobu Chibana; Tsuyoshi Futamase; Hideo Yamada, all of Hamamatsu, Japan

[73] Assignee: Nippon Gakki Seizo Kabushiki Kaisha, Hamamatsu, Japan

[21] Appl. No.: 734,664

[22] Filed: Oct. 21, 1976

[30] Foreign Application Priority Data

Oct. 23, 1975 [JP] Japan ..... 50-127820

[51] Int. Cl.[2] ..... G10H 1/00

[52] U.S. Cl. ..... 84/1.19; 84/1.11; 84/1.12

[58] Field of Search ..... 84/1.03, 1.01, 1.19, 84/1.11, 1.24, 1.26

[56] References Cited

U.S. PATENT DOCUMENTS

| | | | |
|---|---|---|---|
| 3,764,721 | 10/1973 | Maynard | 84/1.24 |
| 3,956,960 | 5/1976 | Deutsch | 84/1.19 |
| 3,992,971 | 11/1976 | Chibana et al. | 84/1.11 |
| 4,000,675 | 1/1977 | Futumpse et al. | 84/1.01 |

*Primary Examiner*—Robert K. Schaefer
*Assistant Examiner*—Vit W. Miska
*Attorney, Agent, or Firm*—Spensley, Horn & Lubitz

[57] ABSTRACT

An electronic musical instrument capable of changing a slope portion of a filter characteristic continuously from start to completion of production of a musical tone.

The inventive electronic musical instrument changes a filter slope in a frequency region above or below a cut-off frequency with lapse of time and, in order to achieve such change in the filter slope, changes a slope factor continuously from start to completion of production of the tone. The instrument is also capable of changing the cut-off frequency.

An example of a low-pass filter is shown in which a desired form of a successively changing filter slope can be obtained by employing four slope factor values and three values representing a speed of change of the slope factors as well as three cut-off frequency values and two values representing a speed of change of the cut-off frequencies.

5 Claims, 10 Drawing Figures

ELECTRONIC MUSICAL INSTRUMENT HAVING AN ELECTRONIC FILTER WITH TIME VARIANT SLOPE

BACKGROUND OF THE INVENTION

This invention relates to an electronic musical instrument of a type having a filtering function wherein the slope of a filter can continuously be changed.

In general natural musical instruments such as, for example, wind instruments, piano, etc., a spectrum envelope of a musical tone which determines its tone color changes dependent upon an emphasis placed on performance or upon in advancement of attenuation. For example, in case of a wind instrument such as a trumpet, when it is played with a small volume, the slope of the level of frequency components is steep in a higher frequency range whereas when it is played with a large volume, the slope is gradual in the higher frequency range, i.e., the inclination of the slope tends to become more gradual as the volume increases. In the case of a piano, the slope becomes steep as the attenuation of the tone is advanced. The steep slope in the spectrum envelope means that the amount of attenuation is large in harmonic components of higher orders in the spectrum envelope determining a tone color, i.e., an effective level of these harmonic components is low and number of harmonics contained in the spectrum envelope tends to be decreased. On the other hand, a gradual slope means the reverse to the above. Such variations in the spectrum envelope are accepted as natural to a human sense.

SUMMARY OF THE INVENTION

It is, therefore, an object of the present invention to provide an electronic musical instrument capable of achieving the aforementioned variations in the frequency spectrum envelope. The electronic musical instrument according to the invention comprises a filter which has filter characteristic corresponding to a desired spectrum envelope so as to freely and continuously change its filter slope. The term "filter slope" herein means the decay or attenuated portion of the filter characteristic, i.e., a region where frequencies lower than the cut-off frequency are attenuated in case of a high-pass filter and where frequencies higher than the cut-off frequency are attenuated in case of a low-pass filter.

Preferred embodiments of the invention will now be described with reference to the accompanying drawings.

DESCRIPTION OF THE PREFERRED EMBODIMENTS

Figure 1:
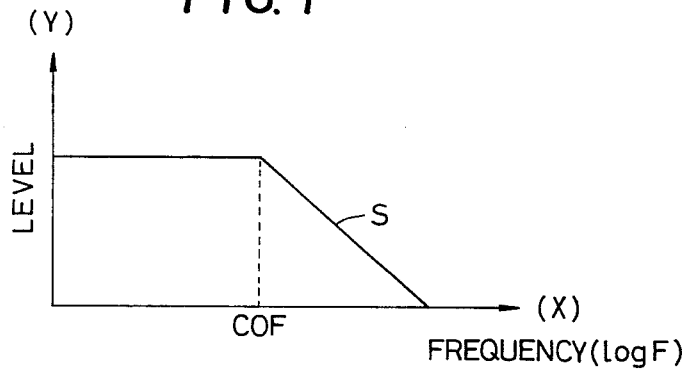
FIG. 1 is a graphical diagram for explaining principle of a digital type filter used in the electronic musical instrument according to the present invention.

The principle of the digital type filter constructed according to the present invention will now be described. This digital type filter is constructed to calculate a function expressing the slope portion as designated by S of the filter characteristic shown in FIG. 1. Assume now that this function is for example constituted by a linear function. The function representing the filter slope S will be $$Y = a X \tag{1}$$

where X represents axis of abscissa, representing frequency information, $a$ an inclination of the slope S, Y an attenuated amount of the frequency information X, i.e. amplitude level of the spectrum envelope. The frequency of the initial point of the filter slope S in FIG. 1 is cut-off frequency COF. If information of an actual frequency is represented by F and is expressed in logarithm, it can be signified by log F. Accordingly, the frequency information X to be utilized for the calculation by the formula (1) can be expressed by $$S = \log F - COF \tag{2}$$

wherein the cut-off frequency COF is also expressed in logarithm. Therefore, if an inclination $a$ of the slope S and information of the cut-off frequency COF are given, the equation (2) can be calculated with the frequency information log F of the actual frequency to be filtered through this filter and, accordingly, the equation (1) can also be calculated thereby to obtain the amplitude level Y of the frequency information X of this digital type filter. The filter of this type is disclosed in the specification of U.S. patent application Ser. No. 634,306 entitled "Electronic musical instrument" assigned to the same assignee as in the present invention.

In the present invention, the inclination $a$ of the filter slope S is used as variable in the above described equation (1) to realize variations in the slope S. Assume now that the function of the inclination $a$ in term of time $t$ is signified by $a(t)$, the equation (1) can be altered to the following:

$$Y(t) = a(t)X \tag{3}$$

This equation (3) means that even if the frequency information X is constant in relation to the filter slope, the amplitude level $Y(t)$ of the frequency may vary with the lapse of time. The frequency information X related to the filter slope corresponds to harmonic components of higher orders in the spectrum envelope in a low pass filter. Since the musical tone change in volume with the lapse of time and the musical tone envelope amplitude is controlled to simulate the volume change with the lapse of time in the known amplitude envelope control circuit of the electronic musical instrument, the variations of the filter slope with the lapse of time substantially coincide with those of the filter slope with the volume change. If the inclination $a$ in the equation (1) is accurately expressed as a function of volume L, the equation (1) can be replaced by the following equation:

$$Y(L) = a(L) \cdot X \quad (4)$$

This equation signifies that the amplitude level Y(L) of the frequency information X in relation to the filter slope varies with magnitude of the musical tone volume L.

Figure 2:
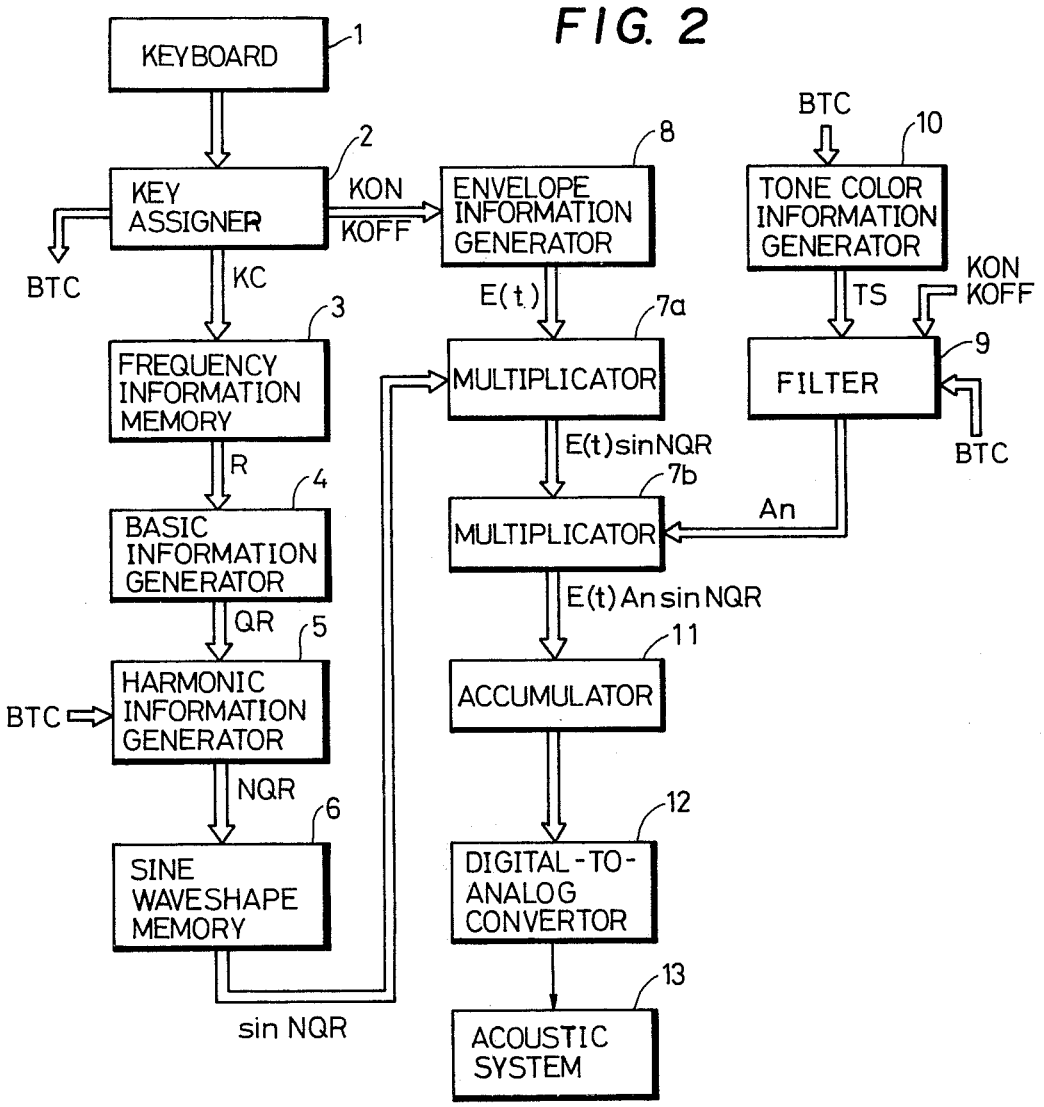
FIG. 2 is a block diagram schematically showing an entire construction of the preferred embodiment of the electronic musical instrument according to the invention.

FIG. 2 is a block diagram schematically showing the entire construction of the electronic musical instrument according to the invention. The basic concept of the entire construction is to calculate amplitude values of respective harmonics of a musical tone waveshape to be produced at respective sample points with a regular time interval, multiply the amplitude values with amplitude coefficients (levels) of the respective harmonics characterizing the tone color of the musical tone and thereafter cumulatively add all the harmonic components to form the desired musical tone waveshape. This basic construction has already been described in U.S. Pat. No. 3,809,786 so that detailed description of the entire construction will be omitted and a filter 9 which constitutes an important feature of the present invention will be described in detail.

Figure 3:
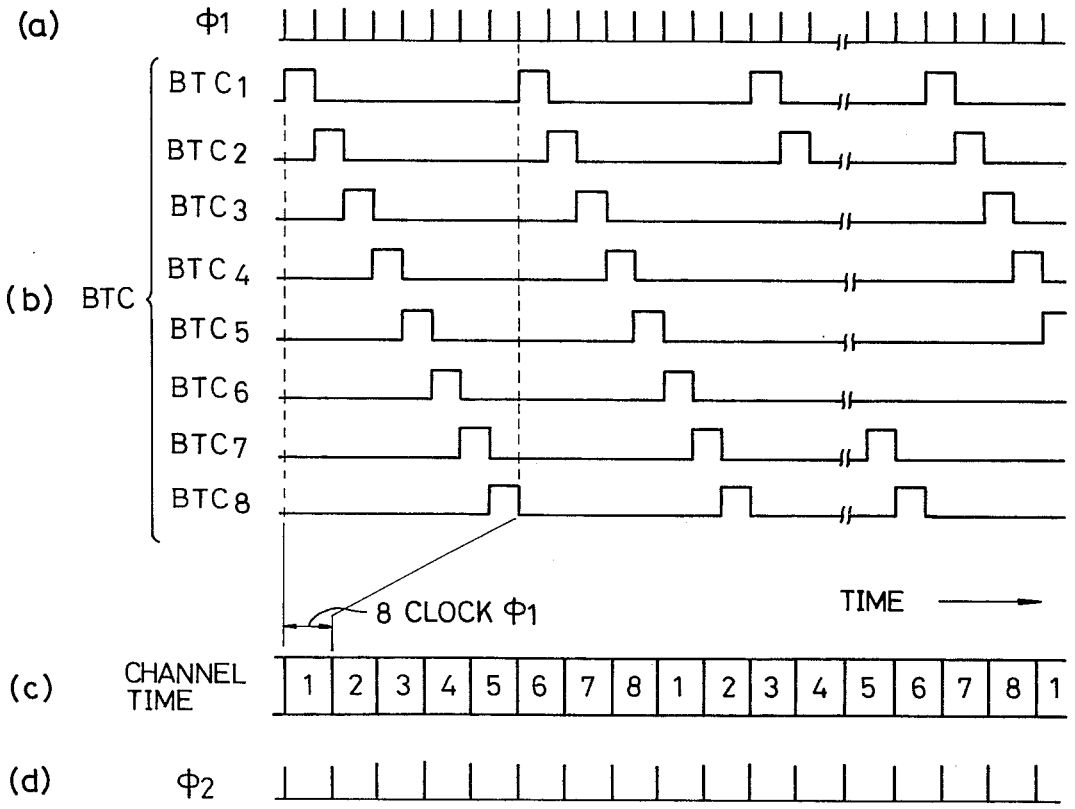
FIGS. 3(*a*) through 3(*d*) are graphical diagram showing the timing chart of various clock pulses used therein.

A key assigner 2 produces key address codes KC representing the key names of depressed keys in response to key-on information supplied from a keyboard circuit 1. These key address codes KC are allotted in a time sharing manner to respective channels defining a maximum number of tones to be produced simultaneously and are read out sequentially and successively at each channel time. The key assigner also produces various clock pulses or time-shared information used for defining time shared slots and controlling time-shared synchronized operation of respective unit constituting the instrument. Assume, for example, that the inventive electronic musical instrument uses higher harmonic and that a maximum number of tones to be produced simultaneously is eight. Clock pulse $\phi_1$ as shown in FIG. 3 are counted by a first counter of eight stages (not shown) to form time sharing time slots for each harmonic and the frequency divided output of this counter is further counted by a second counter of eight stages (not shown) to form time sharing time slots for each of channels corresponding in number to the maximum number of tones to be produced simultaneously. The output of the first counter is hereinafter referred to as an order-of-harmonic signal BTC. This signal BTC is utilized for forming regular time interval of calculation, i.e., for time division controlling with respect to each order of harmonic required to produce the respective harmonic components and sequential sampled amplitude values as will be described later.

The order-of-harmonic signal BTC is produced sequentially and repeatedly from the signal $BTC_1$ for the first harmonic to a signal $BTC_8$ for the eighth harmonic as shown in FIG. 3(*b*). Further, as shown in FIG. 3(*c*), one channel time is allotted to a period of one cycle of the signals $BTC_1$–$BTC_8$, time slots from the first channel to the eight channel repeating with each time slot having time width of the signals $BTC_1$ through $BTC_8$. Once a depressed key has been assigned to a certain channel in the key assigner 2, a key-on signal KON representing depression of the key and a key-off signal KOFF representing release of the depressed key as well as the key address code KC are delivered from the key assigner 2 at the particular channel time. In FIGS. 3(*c*) and 3(*d*), time slots of FIGS. 3(*a*) and 3(*b*) are shown in a diminished scale and one channel time in FIG. 3(*c*) is equivalent to eight shots of master clock pulse $\phi_1$. FIG. 3(*d*) shows a clock pulse $\phi_2$ having a period of one channel time.

A frequency information memory 3 previously stores frequency information R which is a value proportionate to the frequency of each tone. Frequency information R corresponding to the depressed key is read out in response to contents of key address code KC.

A basic information generator 4 cumulatively counts with a certain interval (e.g., every 8 channel times) frequency information R read out in time sharing from the frequency information 3 at each channel time thereby forming basic information QR ($Q = 1, 2, 3 \ldots$) to be used for producing harmonic information. The phase of the fundamental wave is determined by this basic information. The basic information QR is generated in time sharing with respect to the eight tones in synchronization with each channel time shown in FIG. 3(*c*) and the value of the basic information codes not change during one channel time.

The output QR of basic information generator 4 is applied to a harmonic information generator 5.

In the harmonic information generator 5, the basic information QR is sequentially and cumulatively counted at a high time sharing rate corresponding to the order-of-harmonic signal BTC ($BTC_1$–$BTC_8$) and produces in time sharing adders information NQR ($N=1, 2 \ldots 8$) which constitutes address for respective sample points for reading out waveshape information of eight harmonics per tone (the eight harmonics includes the fundamental and seven overtone partials). This determines phase angles of the respective harmonics. Wave values at the respective sample points stored in a sine waveshape memory 6 are read out in response to the address information NQR.

In a first multiplicator 7*a*, the wave value information is multiplied with envelope information E, (*t*) from an envelope information generator 8 by each tone (i.e., by each channel) to deliver to a second multiplicator 7*b* envelope imparted waveform information E(*t*) sin NQR. The envelope information generator 8 generates in a time sharing manner envelope information including attack, decay, sustain and release by each of the tones to be produced simultaneously, i.e., every channel time, in response to the key-on and key-off information from the key assigner 2.

In the second multiplicator 7*b*, the envelope-imparted waveform information E(*t*) sin NQR is multiplied with level information A*n*($n = 1, 2 \ldots 8$) of respective harmonics from the filter 9 by each harmonic to produce waveform information E(*t*)A*n* sin NQR of the respective harmonic components which are controlled in their tone color. Thus, waveform information of the respective harmonic components (controlled in tone color and envelope) is successively calculated with regular time interval and thereafter applied to an accumulator 11. The accumulator 11 adds the waveform value information from the fundamental wave to the eighth (*n*-th) harmonic together by each tone (i.e., for each channel time) to produce sequential sampled point amplitude values of a composite musical tone waveshape. If desired, the wave values of the respective tones may be added together by the kind of keyboard. The musical tone waveshape information of the composite harmonic contents is applied to a digital-analog converter 12 where it is converted to an analog waveshape signal and thereafter is sounded through an acoustic system 13.

If the wave value information read from the sine waveshape memory 6, envelope information from the envelope information generator 8 and level information from the filter 9 are expressed in logarithm, simple adders may be used as the multiplicators *7a, 7b*. It will be noted that the respective component parts of the apparatus operate in complete synchronization by the same harmonic order of the same channel.

A tone color information generator 10 produces tone color information TS for realizing a tone color selected by the performer by operation of tone levers (not shown). This tone color information TS is information defining the levels of the respective harmonics at predetermined relative ratios. The filter 9 performs the above described digital type filtering function and produces level information of a desired filter characteristic by calculation.

Figure 4:
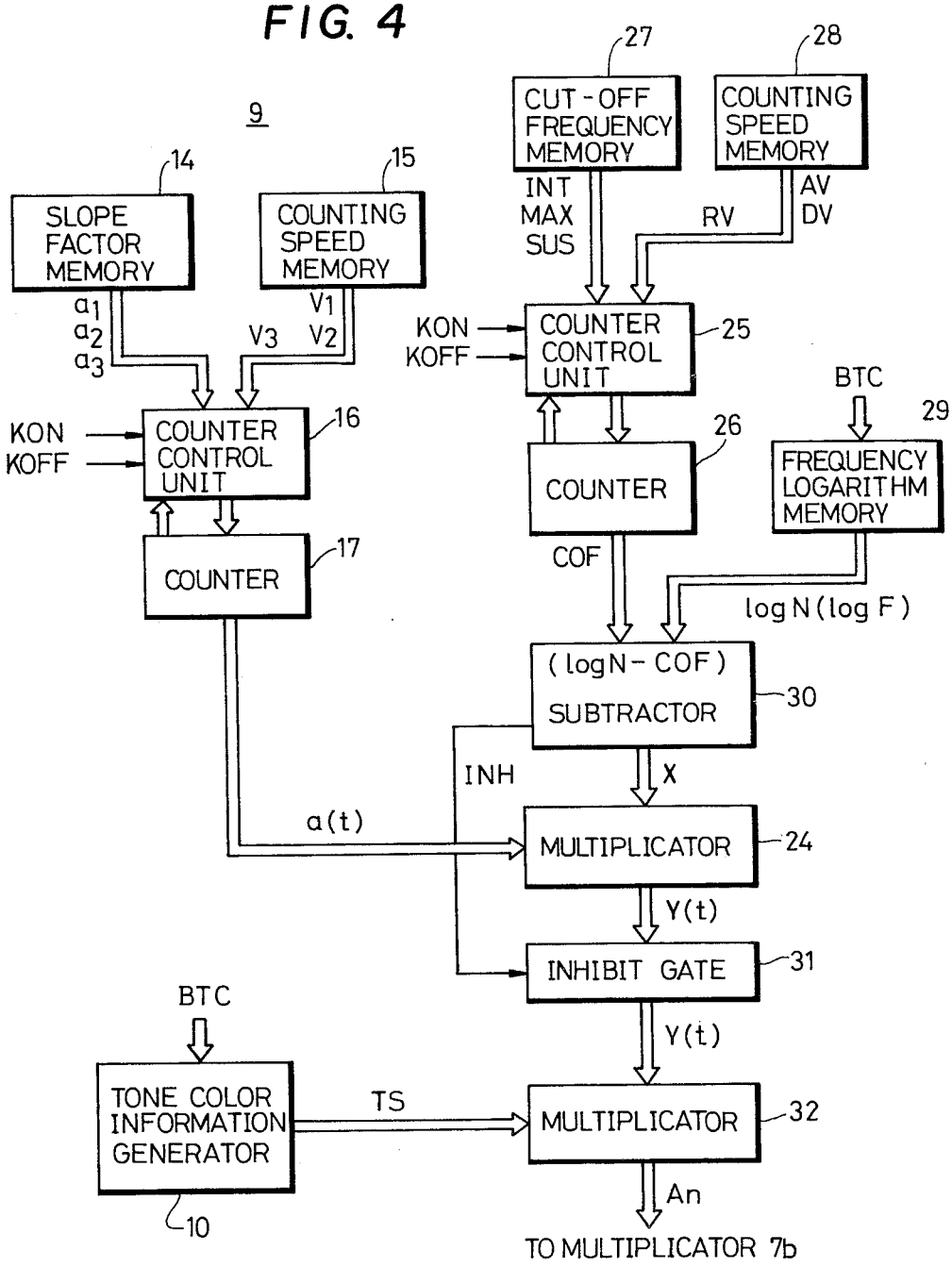
FIG. 4 is a block diagram of one preferred embodiment of the filter used in the arrangement shown in FIG. 2.
Figure 5A:
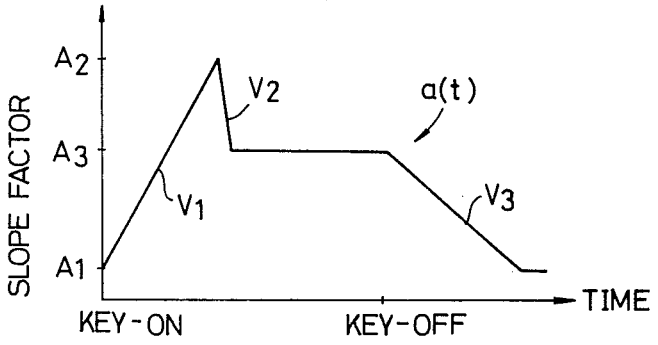
FIG. 5(*a*) and 5(*b*) are graphical diagram showing variation with time of function $a(t)$ determining variation of the filter slope.
Figure 5B:
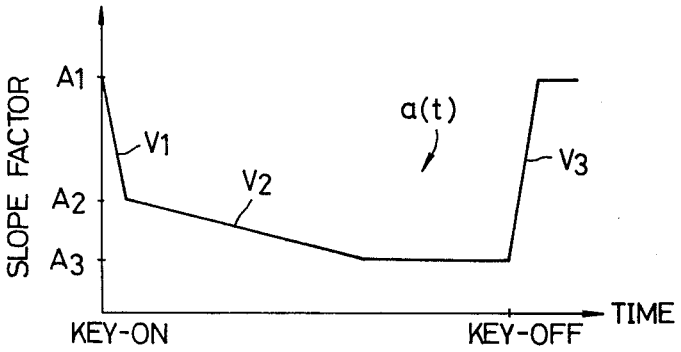

FIG. 4 shows one example of the filter 9 for carrying out the calculation of the equation (3) employed in the electronic musical instrument according to the invention. The function $a(t)$ representative of the filter slope variations is supplied from a counter 17. This embodiment is constructed in such a manner that the filter slope may change continuously from start of production of the tone to completion thereof. The counting operation of the counter 17 is controlled by a counter control unit 16 in response to key-on or key-off signal KON or KOFF from the key assigner 2. The filter 9 also comprises a slope factor memory 14 which stores desired initial count value (i.e., initial filter slope value) $a_1$, first variation finish count value (i.e., first variation finish value of the filter slope) $a_2$, constant count value (i.e., constant value of the filter slope) $a_3$ of the counter 17 and selectively delivers out desired counted values $a_1$, $a_2$, $a_3$ by operation of a suitable switch (not shown). The filter 9 also comprises a counting speed memory 15 which stores information of first variation speed $V_1$, second variation speed $V_2$, third variation speed $V_3$ in various values and selectively produces desired values $V_1$, $V_2$, $V_3$ by operation of a switch (not shown) and supply such values to the counter control unit 16. Thus, the function $a(t)$ of the filter slope is given as a function assuming a form such as shown in FIG. 5. More specifically, the slope changes from the initial value $a_1$ at a speed of the first variation speed $V_1$, and, upon reaching the first variation finish value $a_2$, changes at a speed of the second variation speed $V_2$ when the slope has reached the constant value $a_3$, it stops its change and maintains a constant filter slope. Upon release of a depressed key in the keyboard (i.e., key-off signal KOFF is "1"), the slope varies at a speed of the third variation speed $V_3$ and reaches the initial value $a_1$. It stops its change at the initial value $a_1$. The counter control unit 16 operates to control counting operation for calculating such function $a(t)$ and, as a result a function $a(t)$ as shown in FIG. 5 is obtained. If different values are adopted for the values $a_1$, $a_2$, $a_3$, $V_1$, $V_2$, $V_3$, entirely different functions $a(t)$ as shown in FIGS. 5(*a*) and 5(*b*) can be calculated. Accordingly, the function $a(t)$ can be set as desired.

The counter 17 may comprise an adder (not shown) and a shift register (not shown) of eight stages, which is shift-controlled by channel clock pulses $\phi_2$ shown in FIG. 3(*d*). The shift register is used in a time sharing manner for the counting operation (calculation of the function $a(t)$) for eight channels (for the eight tones). The counter 17 cumulatively counts by adding the counted contents temporarily stored in the shift register and the data applied from the counter control unit 16 together by the adder. The counter control unit 16 comprises various gate circuits (not shown) and comparator circuits (not shown).

When a key is newly depressed and a key-on signal KON is initially produced at the channel time to which the tone corresponding to the depressed key is assigned, the counter control unit 16 selects the counted initial value $a_1$ and applies it to the counter 17. The counter control unit 16 will also selects the first variation speed information $V_1$ upon receipt of the key-on signal KON repeatedly produced at every channel time and repeatedly applies the information $V_1$ to the counter 17 at the timing of the suitable clock (not shown). Accordingly, the counter 17 cumulatively adds the speed information $V_1$ (binary data). The contents of the counter 17 when the cumulative addition is conducted $m$ times is:

"$a_1 + m \cdot V_1$"

When the contents of the counter 17 become the same value as the first variation finish value $a_2(a_2 = a_1 + m \cdot V_1)$, the variation by the first variation speed information $V_1$ is stopped and the first variation is finished. Simultaneously, the counter control unit 16 selects the second variation speed information $V_2$ and applies it to the counter 17. The contents of the counter 17 when the cumulative addition is conducted $l$ times is:

"$a_2 + l \cdot V_2$"

When the contents of the counter 17 become the same value as the constant value $a_3(a_3 = a_2 + l \cdot V_2)$, the variation by the second variation speed information $V_2$ is stopped and the second variation is finished. Thereafter, the constant value $a_3$ is maintained until the depressed key is released. When the depressed key is released, a key-off signal KOFF is produced by the key assigner 2, and the counter control unit 16 selects the third variation speed information $V_3$, which is applied to the counter 17 in a similar manner to the previously described operation. The counter 17 cumulatively adds the information $V_3$. The contents of the counter 17 when the cumulative addition of the information is conducted $k$ times is:

"$a_3 + k \cdot V_3$"

When the contents of the counter 17 become the same value as the initial value $a_1(a_1 = a_3 + k \cdot V_3)$, the variation by the third variation speed information $V_3$ is stopped and the third variation is finished. Since the slope is returned to the initial value at the third variation, a positive or negative sign (i.e., inclination) of the third variation speed information $V_3$ is made opposite to the first variation speed information $V_1$. The speed information $V_1$ through $V_3$ are not limited to binary data but may be given in the form of a suitable clock pulse.

Figure 6:
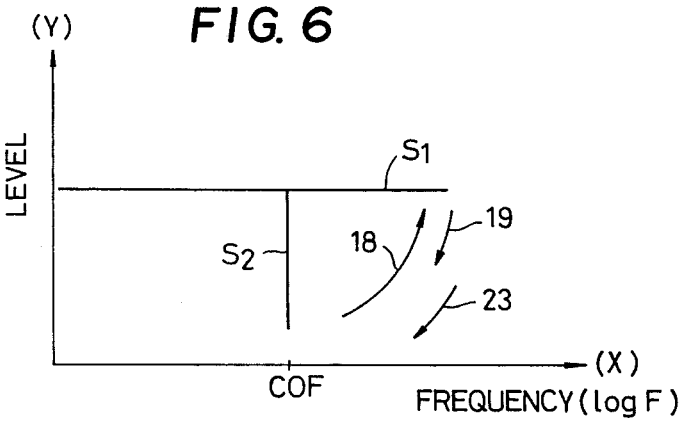
FIG. 6 is a graphical diagram for explaining the variations of the filter in response to the function $a(t)$ shown in FIG. 5(*a*).

If, for example, the function $a(t)$ of the filter slope shown in FIG. 5(*a*) is given by cooperation of the counter control unit 16 and the counter 17 described as above, the filter slope changes as shown in FIG. 6. For example, if the filter slope changes between $S_1$ and $S_2$, it changes in the direction as indicated by an arrow 18, i.e., toward a more gradual slope side, in the first variation ($V_1$). In the second variation ($V_2$), the filter slope changes in the direction of an arrow 19, i.e., toward a steeper slope side, and in the third variation ($V_3$), in the direction of an arrow 23, i.e., toward a further steeper slope side.

The function $a(t)$ of the filter slope variation produced by the counter 17 is applied to a multiplicator 24, which multiplies the function $a(t)$ by the frequency information X related to the filter slope so as to obtain solution of the equation (3). More specifically, the value of the function $a(t)$ at a certain time point expresses the inclination of the filter slope given by the filtering function of the filter 9. Accordingly, by specifying the value of the frequency information X related to the filter slope (i.e., abscissa in FIG. 2) and multiplying the inclination $a$(which is $a(t)$) of the slope by the frequency information X to obtain the solution of the linear equation, the attenuated level Y of the frequency represented by the frequency information X in the filter can be obtained.

The cut-off frequency COF of the filter is adapted to vary with the lapse of time in this embodiment, and further description will be made in this respect. Variation of the cut-off frequency of the filter means variation of the frequency range of the filter slope portion. A counter control unit 25 and a counter 26 are used for changing the cut-off frequency COF. These component parts are constructed substantially in the same manner as the counter control unit 16 and the counter 17.

The cut-off frequency information COF is delivered from the counter 26. In this embodiment, the cut-off frequency is caused to continuously slide from the start to completion of production of a musical tone by controlling counting operation of the counter 26 utilizing the output of the counter 26 as the information COF. A cut-off frequency memory 27 proviously stores initial count value INT, attack finish count value MAX and constant count value SUS of the counter 26 in various values (using a suitable number of bit such as 6 bits). A counting speed memory 28 previously stores information of initial speed AV, first attenuation speed DV, second attenuation speed RV in various values (using for example binary data of 5 bits) and the counting speed of the counter 26 is determined in response to the speed information AV, DV, RV. Accordingly, the speed information AV, DV, RV determines the varying speed of the cut-off frequency. The counter control unit 25 controls the counting operation of the counter 26 in response to the key-on or key-off signals KON or KOFF delivered by the key assigner 2 and the information from the respective memories 27 and 28. For example, the initial count value INT is applied from the memory 27 to the counter 26 at the instant of depression of the key so that counting wil proceed at the initial speed AV. At this time, the initial count value INT is initially delivered from the counter 26 as the information COF, and as the counting advances, the cut-off frequency information COF varies. The counter control unit 25 is adapted to detect the fact that the counted value of the counter 26 has reached the attack finish count value MAX and advance the counting from the attack finish count value MAX the constant count value SUS at the first attenuation speed DV. As count has reached the constant count value SUS, counting is stopped and the constant value SUS is sustained. Thank you release of the depressed key, it starts counting from the constant count value SUS toward the initial count value INT at the second attenuation speed RV. The identification whether addition or subtraction is selected is determined by comparing the respective values INT, MAX, SUS.

A frequency logarithm memory 29 previously stores information related to frequency in logarithm with respect to each harmonic. Information F related to the frequency of a depressed key is expressed by a tone pitch (frequency information) R and an order of harmonic N. The relation in fundamentally represented by $F = N{\cdot}R$. IN this case, the information F changes in accordance with variation in the frequency of the fundamental wave of the tone, and level information Y obtained by calculation takes a different value even for the same order of harmonic if the tone pitch is different.

Such control will hereinafter be referred to as "fixed formant." In a case where relative levels of the harmonic components are to be controlled regardless of the tone pitch of the depressed key, the information F stored in the memory 29 may only that related to the order of harmonic N. In this case, the relationship is $F = N$. That is, the origin of the frequency of abscissa is always the frequency of the fundamental wave (first harmonic) in the filter characteristic shown in FIG. 1, and the variable of abscissa is the frequency corresponding to the order of harmonic. Such control may hereinafter be referred to as "movable formant." The frequency logarithm memory 29 disclosed in this embodiment is of a "movable formant" type storing frequency logarithm information log N of the first to eight harmonics which is utilized as log F in the calculation of the equation (3). In order to cause the filter 9 to function as a filter for achieving the spectrum envelope a filter of the "movable formant" type is desirable. The value of the information log N for the first harmonic is, for example, Q log 1 (where Q denotes a desired constant), for the second harmonic Q log 2, for the third harmonic Q log 3 . . . for the eighth harmonic Q log 8, respectively. Accordingly, log N of the first harmonic is zero. Assuming, for example, that log N of the second harmonic is 12, log N of the fourth harmonic is 24, and the eighth harmonic is 36. The memory 29 sequentially delivers out the logarithm information log N of the respective harmonic frequencies upon receipt of the order-of-harmonic signals BTC ($BTC_1$ through $BTC_8$) from the key assigner 2 as the address signals. The aforementioned memories 27 and 28 deliver out desired values of the respective information INT, MAX, SUX, AV, DV, RV by switching operation of a suitable switch (not shown) by a performer in the same manner as in the memories 14 and 15.

A subtracter 30 implements the following subtraction which is similar to the equation (2) on the basis of the logarithm information log N (corresponding to log F in the equation (2)) of the frequency and the cut-off frequency information COF.

$$\log N - COF = X$$

The information X of the frequency related to the filter slope can be obtained by implementation of this equation.

The multiplicator 24 implements multiplication of the equation (3) based on the slope inclination information $a(t)$ from the counter 17 and the information X so as to obtain level information Y (which is Y ($t$)) of the frequency component (harmonic component) corresponding to the information X. In a case wherein the filter 9 is composed of a low-pass filter, when the calculated result of the subtractor 30 becomes negative (the frequency to be filtered is lower than the cut-off frequency, i.e., the frequency of log N is not within the filter slope portion), it produces an inhibit signal INH so as to operate an inhibit gate 31.

The output of the multiplicator 24 is therefore inhibited at the gate 31 and not applied to the multiplicator 32. In this case, the frequency is not attenuated, so that a signal applied to the multiplicator 32 from the inhibit gate 31 is treated as a signal expressing an attenuated amount 0 dB. When the inhibit gate 31 is inoperative, the information log N is on the slope, so that the output of the multiplicator 24 is passed through the gate 31 and is then applied to the multiplicator 32 as it is.

The multiplicator 32 functions to multiply the filter output level information Y(*t*) of the respective harmonics by tone color information TS from a tone color information generator 10 so as to calculate amplitude level information A*n* of the respective harmonics. The tone color information TS selectively set for realizing a desired constant tone color in the tone color information generator 10 is sequentially delivered out for each harmonic in response to the order-of-harmonic signal BTC. If both the respective tone color information TS and the filter output level information Y(*t*) are expressed in logarithm, the multiplicator 32 may be constructed as a device conducting addition. Thus, the tone color information TS corresponding to the relative levels of the respective harmonic components for achieving a predetermined tone color and the filter output level information Y(*t*) of the respective harmonic components corresponding to the filter characteristic whose filter slope and cut-off frequency successively change are synthesized to produce level information (amplitude coefficient) of the respective harmonic components for determining the tone color which is delivered from the multiplicator 32 to the multiplicator 7*b*.

It is to be noted that the various information expressed in logarithm may suitably be converted to linear information at a proper processing stage.

The foregoing description has been made with regard to a case wherein the filter 9 is low-pass filter. The filter, however, can be constructed with a high-pass filter or a band-pass filter or their combination according to the spectrum envelope to be achieved.

The foregoing description has been made with respect to a case wherein the function *a*(*t*) expressing the variation of the filter slope is a linear function. Any function, however, can also be adopted or a filter slope function *a*(L) depending upon volume L can also be adopted. In this latter case, if function *a*(*t*) is changed in accordance with envelope control information E(*t*), a substantially the same result as the function *a*(L) can be obtained. This can be realized by suitably setting the slope factor memory 14 and the counting speed memory 15 shown in FIG. 4.

What is clamed is:

1. An electronic musical instrument of a type wherein amplitudes of frequency components constituting a musical tone are individually set in accordance with a desired filter characteristic comprising means for changing a slope portion of the filter characteristic, said means comprising:

a filter slope information generation circuit for generating a filter slope variation function *a*(*t*) which changes with time;

a cut-off frequency information generation circuit for generating cut-off frequency information COF which also changes with time;

a memory for storing frequency logarithm information log N of frequencies of respective harmonic orders;

a subtractor for conducting subtraction log N − COF on the basis of the cut-off frequency information COF and the frequency logarithm information log N; and a multiplicator for multiplying the filter slope variation function *a*(*t*) with a value (log N- COF).

2. An electronic musical instrument as defined in claim 1 wherein said filter slope information generation circuit comprises:

a memory storing information of an initial count value, a count value at a time point when a counting speed changes and a finish count value respectively corresponding to predetermined slope factors;

a memory storing a plurality of counting speed information; and a counter for counting and outputting said function *a*(*t*) on the basis of the information read from these memories.

3. An electronic musical instrument as defined in claim 1 wherein said cut-off frequency information generation circuit comprises:

a memory storing information of an initial count value, a count value at a time point when a counting speed changes and a finish count value respectively corresponding to predetermined cut-off frequency;

a memory storing a plurality of counting speed information; and a counter for counting and outputting the time-variant cut-off frequency information COF on the basis of the information read from these memories.

4. In an electronic musical instrument wherein the amplitudes of frequency components constituting a musical tone are individually evaluated, an electronic filter circuit for providing amplitude scale factors for establishing the amplitudes of such components in accordance with a desired time variant filter function, said circuit comprising:

first means for providing a time variant function *a*(*t*) establishing the slope of a portion of said filter function, said portion extending in frequency from a certain cut-off frequency, second means for determining the difference in frequency between the frequency component being evaluated and said certain cut-off frequency, and third means for multiplying the value of the slope function *a*(*t*) at the time that a certain component is evaluated by the determined frequency difference between the frequency of said certain component and said cut-off frequency, thereby to obtain the amplitude scale factors for that component.

5. An electronic filter circuit according to claim 4 wherein said first means comprises;

a slope factor memory storing certain fixed values of the slope function, a counting speed memory storing certain values indicative of different time rates of change of said slope function, and counter and control means for changing the slope function values between extremes corresponding to fixed values accessed from said slope factor memory at rates corresponding to values accessed from said counting speed memory.

* * * * *